US006253892B1

(12) United States Patent
Edwards

(10) Patent No.: US 6,253,892 B1
(45) Date of Patent: Jul. 3, 2001

(54) REMOVABLE LARGE WHEEL ASSEMBLY FOR LUGGAGE WITH SMALL WHEELS

(76) Inventor: Anthony G. Edwards, 13700 Tahiti Way, #153, Marina Del Rey, CA (US) 90292

( * ) Notice: Subject to any disclaimer, the term of this patent is extended or adjusted under 35 U.S.C. 154(b) by 0 days.

(21) Appl. No.: 09/430,480

(22) Filed: Oct. 29, 1999

(51) Int. Cl.[7] ..... A45C 5/14
(52) U.S. Cl. ..... 190/18 A; 190/109; 280/37
(58) Field of Search ..... 280/37, 47.2; 190/18 A

(56) References Cited

U.S. PATENT DOCUMENTS 3,258,275 * 6/1966 Schaefer et al. ..... 280/47.2
3,997,038 * 12/1976 Walker ..... 190/18 A X
4,354,583 * 10/1982 Walker ..... 190/18 A
4,758,009 * 7/1988 Abel ..... 190/18 A X
4,900,043 * 2/1990 Kho ..... 190/18 A X
5,456,342 * 10/1995 Rekuc et al. ..... 190/18 A
5,575,391 * 11/1996 Gerch ..... 190/18 A X
5,676,286 * 10/1997 Song ..... 190/18 A
5,749,503 * 5/1998 Wulf et al. ..... 190/18 A X
5,984,154 * 11/1999 Scicluna ..... 190/18 A X

FOREIGN PATENT DOCUMENTS

1539021 * 1/1979 (GB) ..... 190/18 A
2276148 * 9/1994 (GB) ..... 190/18 A

* cited by examiner

*Primary Examiner*—Sue A. Weaver

(57) ABSTRACT

A removeable large wheel assembly having and axle with fasteners at each end, said axle being inserted through holes drilled in mounting blocks of small wheels or through holes drilled through additional mounting blocks added to the bottom of the luggage with sleeves placed over said axle between the inner side of each wheel and the outer side of each corresponding mounting block maintaining said wheels from touching the outside edge of said luggage case. The assembly with larger wheels makes transporting the luggage, whether large or small, mush easier and more stable but when removed still permit storage in the overhead compartment of the aircraft in the case of smaller pieces of luggage.

6 Claims, 2 Drawing Sheets

REMOVABLE LARGE WHEEL ASSEMBLY FOR LUGGAGE WITH SMALL WHEELS

BACKGROUND OF THE INVENTION

At the present time, carryon luggage for travel by aircraft is usually provided with wheels to aid in their transport and improve mobility. Such wheels are restricted in size to allow maximum size for the luggage itself which is limited in extent by the airlines. For example, United Airlines restricts carryon luggage to 22 by 14 by 9 inches. American Airlines restricts carryon luggage to 23 by 13 by 9 inches. British Airlines restricts carryon luggage to 22 by 16 by 8 inches.

Even larger luggage which must be checked is generally provided with relatively small wheels to allow maximum size for the luggage case. Such larger luggage, even with a front set of wheels and a back set of wheels can be unstable and can be easily overturned when being pulled or pushed in their transport.

Accordingly, there is a need for means providing such luggage with larger wheels for greater mobility and ease in transport but which can be removed when no longer needed so that carryon luggage will meet airline size requirements and larger luggage can be checked in the usual manner.

Applicant is unaware of any prior art providing for a removable large wheel assembly which can be added to conventional small wheeled carryon luggage or larger luggage which must be checked and then removed just before boarding aircraft or just before checking larger luggage.

OBJECTS OF THE INVENTION

Accordingly, it is an object of the invention to provide a relatively large wheel assembly to be added to luggage having relatively small wheels so that such luggage can be more easily transported and rendered more mobile.

Another object of the invention is to provide a large wheel assembly which is removable after being added to luggage having relatively small wheels so that such luggage can be more easily transported and rendered more mobile.

A further object of the invention is to provide a large wheel assembly, which, after being removed from luggage having small wheels, can be stored either inside such luggage or in outside containers attached to the luggage.

A still further object of the invention is to provide a large wheel assembly which has relatively few component parts and can be easily assembled and disassembled.

A yet further object of the invention is to provide a large wheel assembly which is relatively inexpensive to manufacture and assemble.

BRIEF SUMMARY OF THE INVENTION

The large wheel assembly is made up of an axle, two large wheels, two sleeves for insertion in the axle, and fasteners to maintain the wheels in position when assembled with the axle.

The mounting blocks or feet of conventional carryon luggage or larger luggage are drilled with an appropriate size hole to receive the axle. If the particular luggage does not permit this hole drilling, then suitable mounting blocks with holes are added to the bottom of the luggage. The sleeves keep the wheels extended outside the sides of the luggage and prevent the wheels from touching the sides of the luggage. The fasteners are removable and when in position at the ends of the axle, keep the wheels in proper location If the luggage case is provided with an attached pouch or pocket located on the outside sides of the case, the wheels, sleeves, and fasteners can be stored there if the pouch or pocket is large enough, and most are. If not so provided, then these component parts can be stored inside the luggage along with the axle.

If the luggage case has an outside sleeve member long enough to receive the axle, the axle can be stored there. Or the luggage case can be specially made to have an outside sleeve adapted to receive the axle.

DETAILED DESCRIPTION OF PREFERRED EMBODIMENTS OF THE INVENTION

Figure 1:
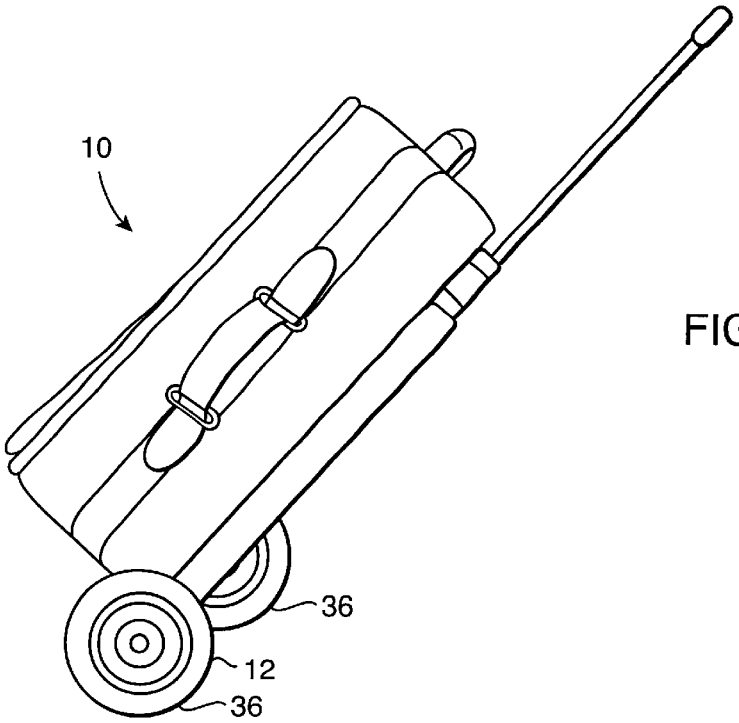
FIG. 1 is a perspective view of an embodiment of the invention showing a conventional carryon luggage case with a large wheel assembly in place.
Figure 2:
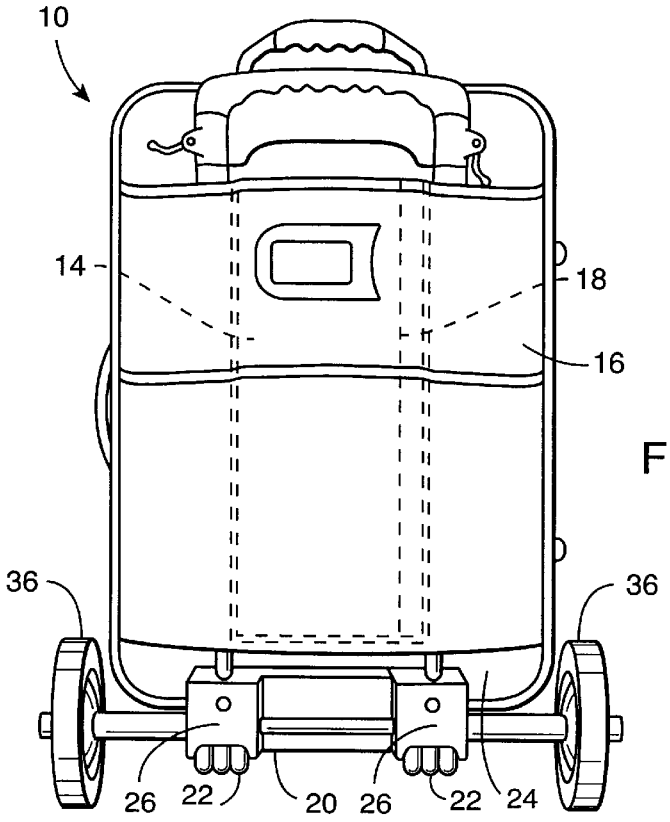
FIG. 2 is a rear elevational view of an embodiment of the invention showing a conventional carryon luggage case with a large wheel assembly in place.
Figure 3:
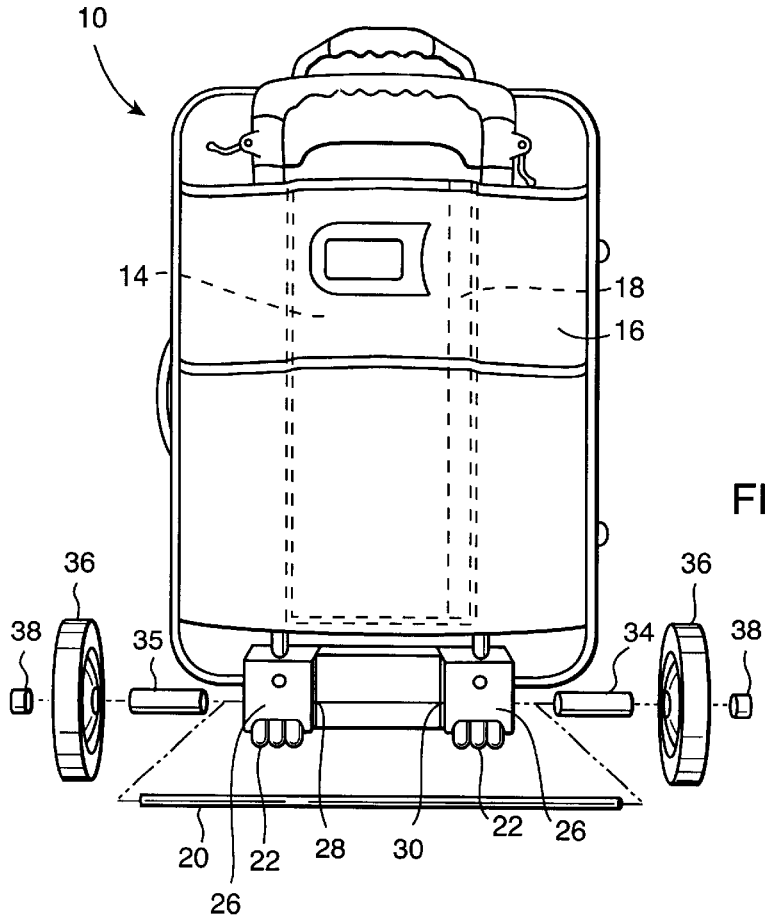
FIG. 3 is a rear elevational view of an embodiment of the invention showing a conventional carryon luggage case with a large wheel assembly in exploded view.
Figure 4:
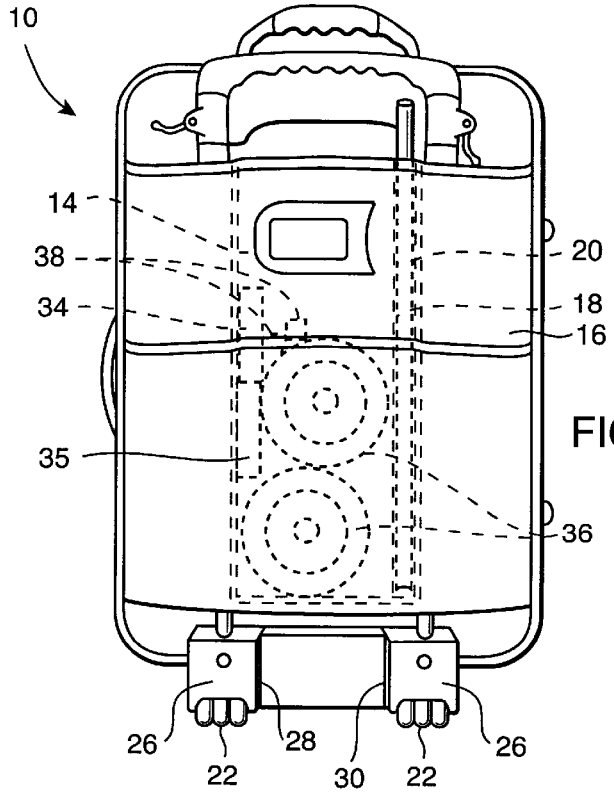
FIG. 4 is a rear elevational view of an embodiment of the invention showing a conventional carryon luggage case with the components of a large wheel assembly stored in an outside pouch and in an outside longitudinal sleeve, the pouch and sleeve each formed on, or attached to, the exterior of the luggage case.

As shown in the drawings, a preferred embodiment of the invention has a conventional carryon luggage case 10 with a removable large wheel assembly 12 in place. Luggage case 10 has a pouch or pocket 14 attached to its exterior side 16 and is also provided with a vertical or longitudinal sleeve 18 to receive the axle 20 of the large wheel assembly 12.

The luggage case 10 is provided with conventional small wheels 22 secured to the bottom portion 24 of the luggage case 10 with mounting blocks 26. Holes 28 and 30 are drilled in the mounting blocks 26 to receive the axle 20. Luggage that does not permit the drilling of such holes must have suitable mounting blocks (not shown) added to their bottom portion and have suitable holes provided therein.

Sleeves 35 and 34 are removably inserted on the axle 20 at each end to maintain the large wheels 36 in position away from the sides of the luggage case 10. Fasteners 38 at the ends of axle 20 keep the large wheels 36 from falling off the axle 20.

At the time of boarding the aircraft, or upon checking larger luggage, as the case may be, the large wheel assembly is easily disassembled with the axle 20 inserted in sleeve 18 and the large wheels 36, sleeves 35 and 34, and fasteners 38, placed inside pouch 14. Alternatively, these component parts of the large wheel assembly 12 may be placed inside luggage case 10.

The above detailed description of a preferred embodiment of the invention relates to carryon luggage. However, the same large wheel assembly, and related members such as pouch 14 and longitudinal sleeve 18 with drilled holes in the mounting blocks of small wheels of larger luggage, may be applied and used in conjunction with such larger luggage.

Although the invention is not limited to a particular size of large wheel, which may vary in diameter from 4 to 10 inches or larger, preferred sizes of large wheels range from 6 inches to 10 inches in diameter. The small wheels of conventional luggage, whether carryon or not, generally range from 2 to 3 inches in diameter. The diameter of axle

20 is preferably about ½ inch but may vary plus or minus ⅛ inch or more so long as it has enough strength to support the luggage case 10 and its contents.

Large wheels 36 may be made of any suitable material such as ABS plastic or nylon or metal with a co-injected rubber tread portion.

Fasteners 38 may be cap members closing each end of axle 20, and may be threaded thereon or friction fit. Alternatively, fasteners 38, may be clip members securing each outer end of axle 20. Another type of fastener 38 may be a pin member inserted into an opening through each end of axle 20.

Although I have described the invention in detail with reference to the accompanying drawings illustrating a preferred embodiment of the invention, it is understood that numerous changes may be made in the details of construction and arrangement of parts without departing from the spirit and scope of the invention as hereinafter claimed.

I claim:

1. In a luggage case provided with small wheels and holes drilled in mounting blocks located at the bottom of said luggage case, said luggage case having an outside pocket and outside longitudinal sleeve on the exterior side of said luggage case, the improvement comprising:

a removeable large wheel assembly comprising an axle inserted into said holes of said mounting blocks, a large wheel inserted at each end of said axle, a fastener located at each end of said axle to secure said large wheel in position, and a sleeve inserted on said axle between the inner portion of each of said large wheels and outer side of each mounting block of said luggage case to maintain said large wheels in position whereby the luggage case may be moved on the large wheels with the small wheels in place on the mounting blocks.

2. A removeable large wheel assembly for a luggage case having small wheels and holes drilled in mounting blocks of said small wheels, said mounting blocks being located at the bottom of said luggage case, comprising:

an axle inserted in said holes of said mounting blocks, a large wheel inserted at each end of said axle, a fastener located at each end of said axle to secure said large wheels in position, and a sleeve inserted on said axle and located between the inner side of each of said large wheels and the outer side of each mounting block of said luggage case to maintain said large wheels in position whereby the luggage case may be moved on the large wheels with the small wheels in place on the mounting blocks.

3. A removable large wheel assembly according to claim 2 in which the exterior of said luggage case is provided with an outside pocket for storage of said large wheels, said sleeves, and said fasteners.

4. A removable large wheel assembly according to claim 2 in which the exterior of said luggage is provided with a longitudinal sleeve formed to receive said axle.

5. A removable large wheel assembly according to claim 2 in which the exterior of said luggage case is provided with a longitudinal sleeve formed to receive said axle and is provided with an outside pocket for storage of said large wheels, said sleeves, and said fasteners.

6. In a luggage case provided with small wheels and holes drilled in the mounting blocks of said small wheels located at the bottom of said luggage case, said case having an outside pocket and outside longitudinal sleeve on the exterior side of said luggage case for storage of the wheel assembly the improvement comprising:

a removeable large wheel assembly comprising an axle with a fastener at each end of said axle to secure large wheels in place, two sleeves of such length that when the sleeves are placed on the axle between the inner side of each wheel and the outer side of each corresponding mounting block they prevent the wheel from touching the outer edge of said luggage and maintain the proper position of the wheels.

* * * * *